US005557942A

United States Patent [19]

Kim et al.

[11] Patent Number: 5,557,942

[45] Date of Patent: Sep. 24, 1996

[54] METHODS AND APPARATUS FOR EQUALIZING PRESSURE BETWEEN A REFRIGERATING COMPARTMENT AND AMBIENT AIR

[75] Inventors: Sang U. Kim, Suwon; Suk Bang, Youngin, both of Rep. of Korea

[73] Assignee: Samsung Electronics Co., Ltd., Suwon, Rep. of Korea

[21] Appl. No.: 334,078

[22] Filed: Nov. 4, 1994

[30] Foreign Application Priority Data

Nov. 30, 1993 [KR] Rep. of Korea ..... 1993-25777 U
Feb. 4, 1994 [KR] Rep. of Korea ..... 1994-2167 U

[51] Int. Cl.[6] ..... F25D 21/14

[52] U.S. Cl. ..... 62/288; 62/291

[58] Field of Search ..... 62/285, 288, 289, 62/291; 137/59–62

[56] References Cited

U.S. PATENT DOCUMENTS 4,693,091 9/1987 O'Mara et al. ..... 62/272
4,918,935 4/1990 Trent ..... 62/285 X

FOREIGN PATENT DOCUMENTS 62-59369 3/1987 Japan .
62-60883 4/1987 Japan .

*Primary Examiner*—Henry A. Bennett
*Assistant Examiner*—Susanne C. Tinker
*Attorney, Agent, or Firm*—Burns, Doane, Swecker & Mathis, L.L.P.

[57] ABSTRACT

The pressure within a compartment of a refrigerator is kept equalized with ambient atmospheric air to facilitate the opening of the refrigerator door. An air passage capable of communicating the compartment with ambient air is closed when the compartment pressure is equal to the ambient air pressure, and is automatically opened when the compartment pressure become less than the ambient air pressure. The opening of the air passage is under the control of water contained in a trap portion of defrost water drain conduit of the refrigerator. The level of that trapped water fluctuates in height in response to differences in pressure between the compartment and ambient air, and the change in that height is used to open (or close) the air passage. The trapped water itself can be used to block the air passage, or a closure member floating on the water can block the air passage.

10 Claims, 4 Drawing Sheets

METHODS AND APPARATUS FOR EQUALIZING PRESSURE BETWEEN A REFRIGERATING COMPARTMENT AND AMBIENT AIR

BACKGROUND OF THE INVENTION

This invention relates to a pressure equilibrium apparatus for a refrigerator, more particularly to a pressure equilibrium apparatus for a refrigerator which maintains a pressure equilibrium between for a compartment and the ambient atmosphere.

A conventional refrigerator having a reservoir tube for containing defrost water is shown in FIG. 4. A refrigerator comprises a cabinet 1 which forms a body and door(s) 2 which is/are hingedly mounted at the front side of the cabinet 1. Further, a gasket 3 having a magnet (not shown) therein is provided at the door 2 for sealing the gap between the door 2 and the cabinet 1. After the door is closed, a cooling fan adjacent to an evaporator (not shown) is operated to pull the inside air of the compartment toward the evaporator. Because the heat-exchanged air is at a lower temperature, the pressure of the air is relatively lowered. That creates a vacuum inside of the compartment. Owing to the pressure difference between the inside of the compartment and the outside thereof, an additional force corresponding to the pressure difference is required to open the door, which is one problem of the conventional refrigerator.

Meanwhile, to vent the water melted by a frost which surrounds on an evaporator, a venting pipe 4 is provided in which one end of the venting pipe is connected to the inside of the compartment, while other end thereof is connected to the outside of the compartment. The one end of the venting pipe is extended to the vicinity of the evaporator and the other end of the venting pipe is extended to an evaporator dish 6 which is mounted in a machinery chamber 5. Thus, the water melted from a frost or the defrost water is conducted through the venting pipe 4 and collects in the evaporating dish 6 in which the water is evaporated. Further, a U shaped pipe 7 is provided at the middle of the venting pipe to trap a predetermined volume of the defrost water. Due to the presence of the trapped water, a relatively hot air of the outside can not be introduced into the inside of the compartment through the venting pipe, while a relatively cold air inside of the compartment can not discharge to the outside therethrough. The typical arrangement of that apparatus is described in Japanese Patent Laid Open Publication No. 1987-59369 and Utility Model Laid Open Publication No. 1987-60883, respectively.

However, since the air flow between the outside of the compartment and the inside thereof is interrupted by the defrost water trapped in the U shape pipe, above-described problem relating to the the pressure difference can not be solved which occurs when the door is closed. That is, the additional force corresponding to the pressure difference is still required to open the door.

SUMMARY OF THE INVENTION

An object of the present invention is to provide a pressure equilibrium apparatus for a refrigerator which can maintain a pressure equilibrium between a compartment and an outside thereof after closing the door, so that the door can be opened without difficulty.

According to the present invention, a refrigerator comprises a reservoir tube of which one end is connected to the compartment and the other end is connected to ambient air, and defrost water is trapped between the ends, the tube further comprises a pressure equilibrium apparatus, whereby outside air can enter the compartment through the tube when the cold air pressure of the compartment is lower than air pressure but the pressure equilibrium apparatus blocks communication between ambient air and the compartment when the cold air pressure of the compartment equals ambient air pressure.

Further, the pressure equilibrium apparatus comprises a bypass passage which is connected to both ends of said tube.

Furthermore, the one end portion connected to air in the compartment is placed above the maximum level of trapped water, and the other end portion connected to ambient air is placed above the water level occurring when cold air pressure of the compartment is lower than ambient air pressure and is placed below the water level occurring when cold air pressure of the compartment equals ambient air pressure. Thus, the water itself physically blocks the bypass passage.

Alternatively, the pressure equilibrium apparatus comprises an outside air conduit which is formed on one end of the tube and is placed above the maximum level of trapped water, and a closure member which is placed on an opening of the outside air conduit.

Further, the opening is closed by an upper end of the closure member when cold air pressure of the compartment equals ambient air pressure, and the opening is opened when cold air pressure of the compartment is lower than ambient air pressure. A lower end of the closure member floats on the surface of the trapped water so that the upper end moves up or down depending upon the level of the trapped water.

DESCRIPTION OF THE PREFERRED EMBODIMENTS

First Embodiment

Figure 1:
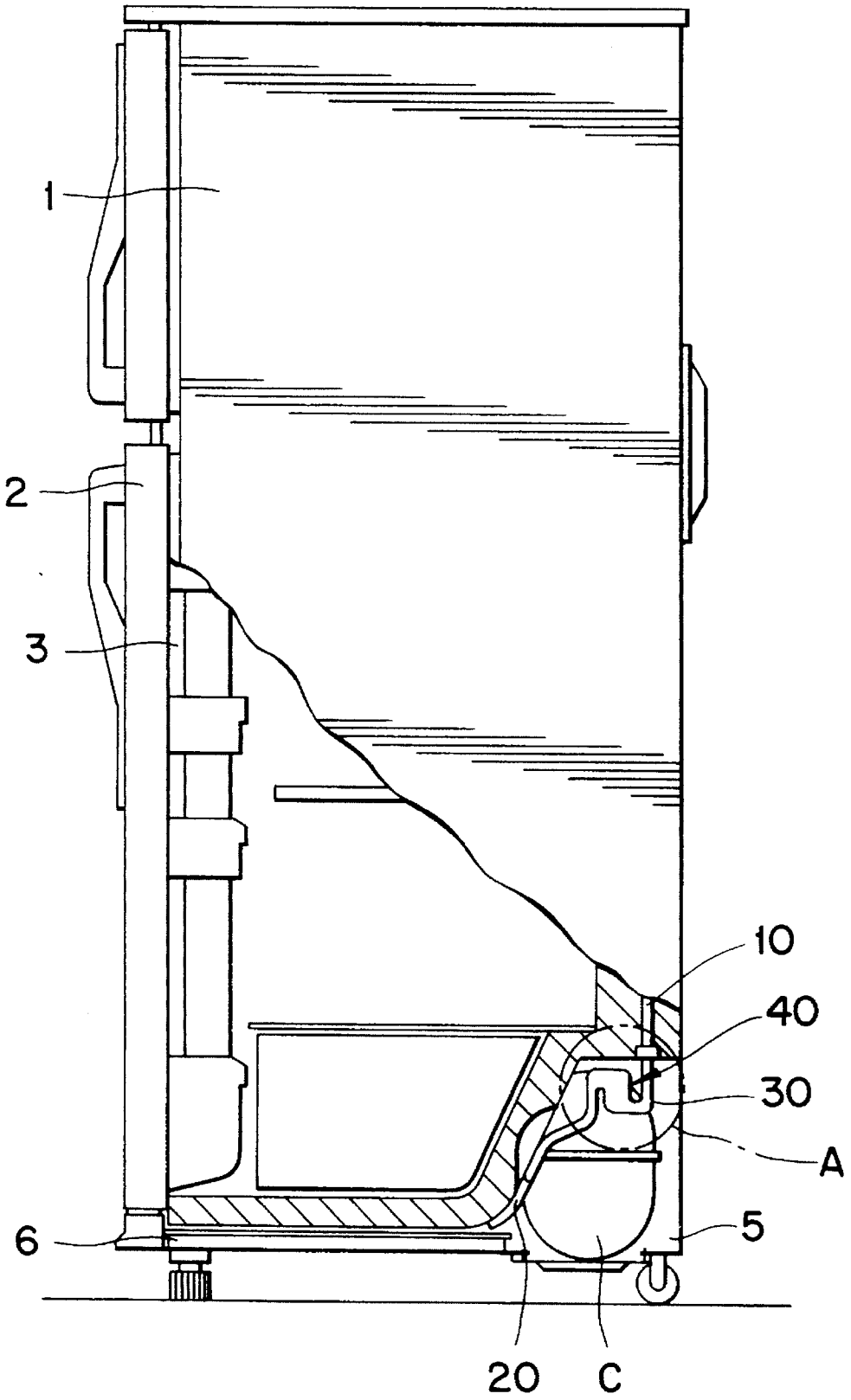
FIG. 1 is a side view, partially cut away, of a refrigerator having a first embodiment of a pressure equilibrium apparatus according to the present invention.
Figure 2:
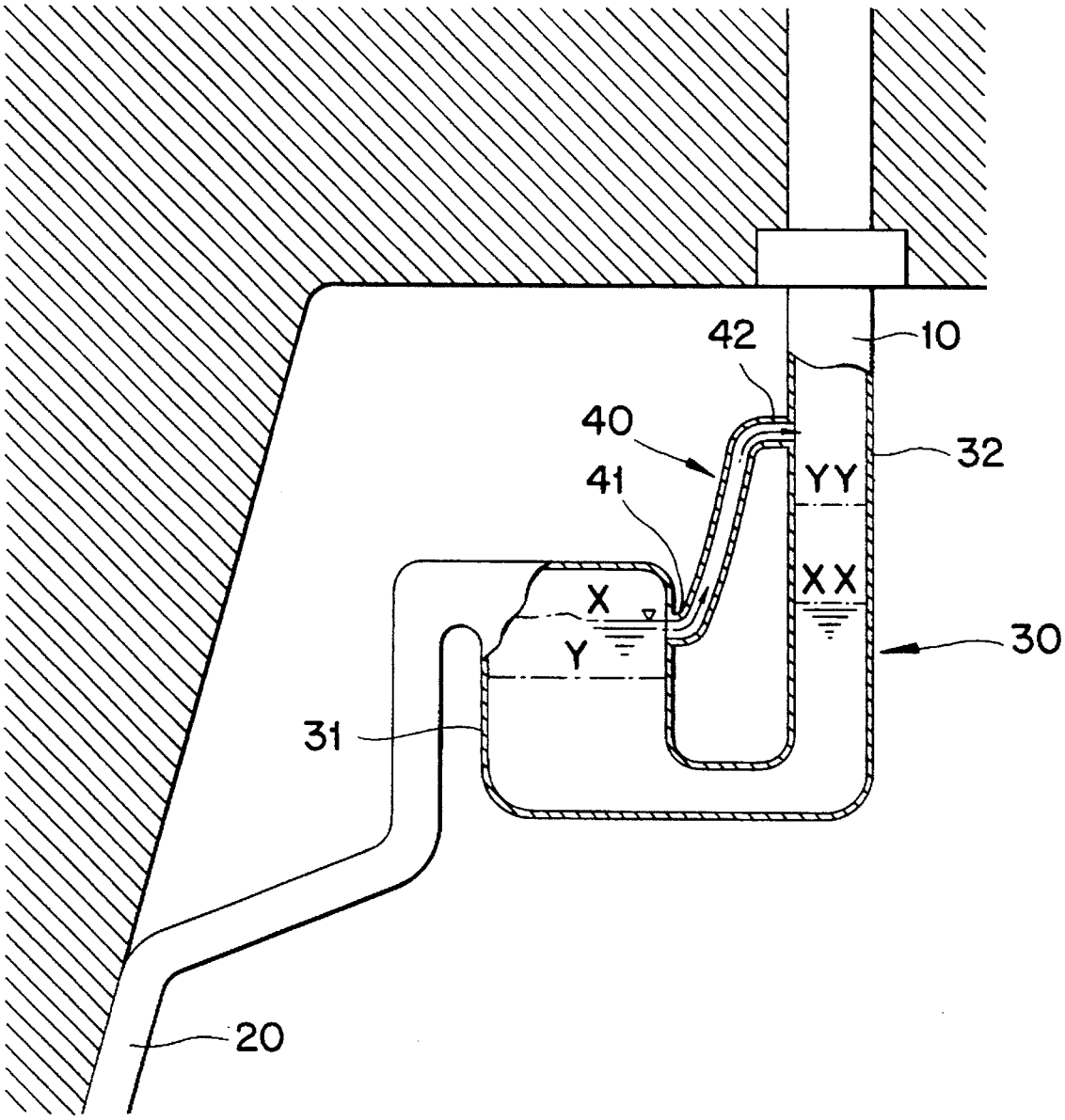
FIG. 2 is an enlarged sectional view of the pressure equilibrium apparatus of FIG. 1.

In FIGS. 1 and 2, the present apparatus comprises a first venting pipe 10 which is connected to the interior of an compartment for discharging the defrost water generated from the evaporator (not shown), a second venting pipe 20 which is connected to the ambient atmosphere surrounding the refrigerator, and a reservoir tube 30 which is connected to both the first venting pipe 10 and the second venting pipe 20 and in which the defrost water is always contained for not permitting the inflow of the outside air into the compartment as well as the outflow of the air in the compartment toward the outside of the. A bypass pipe 40 which is connected to both ends of the tube 30. Numeral 1 designates a cabinet, 2 a door of a refrigerator and 3 a gasket.

The first venting pipe 10 is provided in the interior of the refrigerator and the upper portion thereof is connected to a chamber which houses an evaporator (not shown) and guides the flow of the defrost water or the water which is gathered by melting the frost which surrounds the evaporator.

The second venting pipe 20 is provided in a machinery chamber 5 which is formed at the exterior of the compartment and guides the discharging flow of the defrost water passed through the first venting pipe 10. The defrost water via the second venting pipe 20 is collected in an evaporating dish 6 which is placed at a bottom portion of a refrigerator and is evaporated by a heat of compressor C.

The reservoir tube 30 is provided also in the machinery chamber 5 and is used for interconnecting the first venting pipe 10 and the second venting pipe 20. The configuration of the reservoir tube 30 is shaped as a "U" for trapping a constant amount of defrost water therein. Since the trapped water blocks the reservoir tube 30, the ambient air cannot inflow into the compartment and also the air of the compartment can not discharge to the outside. If the effect of the air barrier can be achieved by a reservoir tube of a different shape, then the configuration is not necessarily restricted to the "U" shape. Additionally, the reservoir tube 30 need not always be positioned at the outside of the compartment, but may be placed in a wall of the compartment.

The bypass tube on air passage 40 is shaped for connecting both ends 31,32 of the reservoir tube 30 as shown in FIG. 2. One end 41 of the bypass tube 40, which is connected to the one end 31 of the reservoir tube 30, is located between a water level X that occurs during a normal or pressure equilibrium state and a water level Y that occurs during a pressure differential or non-equilibrium state created soon after the door is closed. The other end 42 of the bypass tube 40, which is connected to the other end 32 of the reservoir tube 30, is located above both a water level XX that occurs during the normal state and a water level YY that occurs during the pressure differential state.

In this description, the normal state means that the door(s) is (are) in a closed condition and the ambient pressure outside of the compartment is the same as that inside of the compartment. Therefore, the level of water trapped in the reservoir tube 30 is X and XX shown in FIG. 2. In the normal state, the water levels X and XX are the same.

In addition, the non-equilibrium state, occurring soon after closing the door, means that the door(s) is (are) closed and pressure inside of the compartment is lower than that outside of the compartment. Because the door is closed abruptly and a fan is simultaneously operated to pull the air in the compartment toward the evaporator, the pressure inside of the compartment is lower than that outside thereof. More, as the temperature of the air passing the evaporator drops, the pressure inside the compartment is further lowered. Therefore, the levels of water trapped in the reservoir tube 30 are Y and YY shown in FIG. 2. That is, the pressure of the first venting pipe 10 which is connected to the inside of the compartment is lower than that of the second venting pipe 20 which is connected to the ambient air outside of the compartment. Owing to the pressure difference the water level Y in the one end 31 of the reservoir tube 30 is below the normal state level X and the water level YY in the other end 32 is higher than the normal state level XX. The operation of this first embodiment will be explained later.

Second Embodiment

Figure 3:
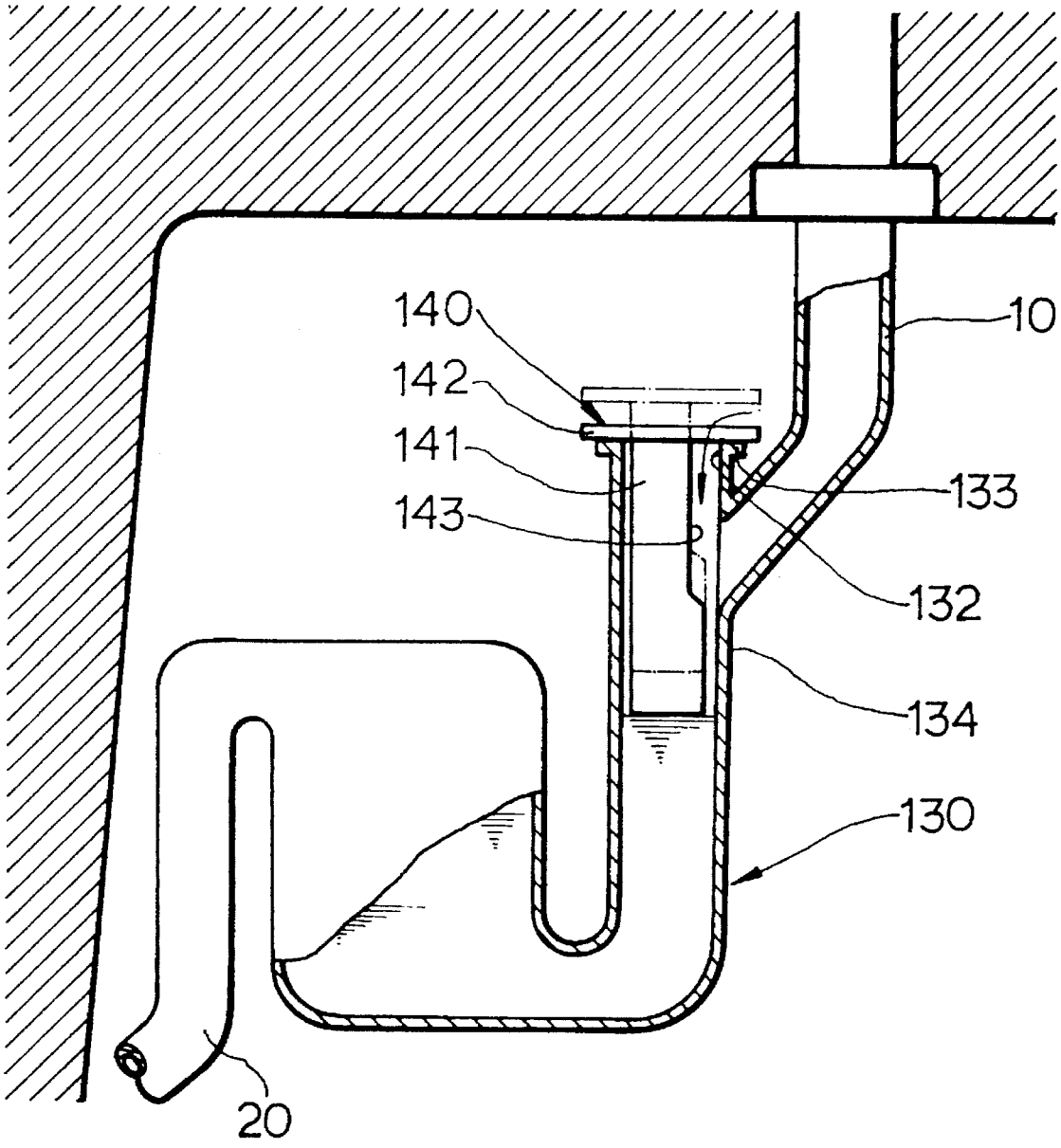
FIG. 3 is an enlarged sectional view of a second embodiment of a pressure equilibrium apparatus.
Figure 4:
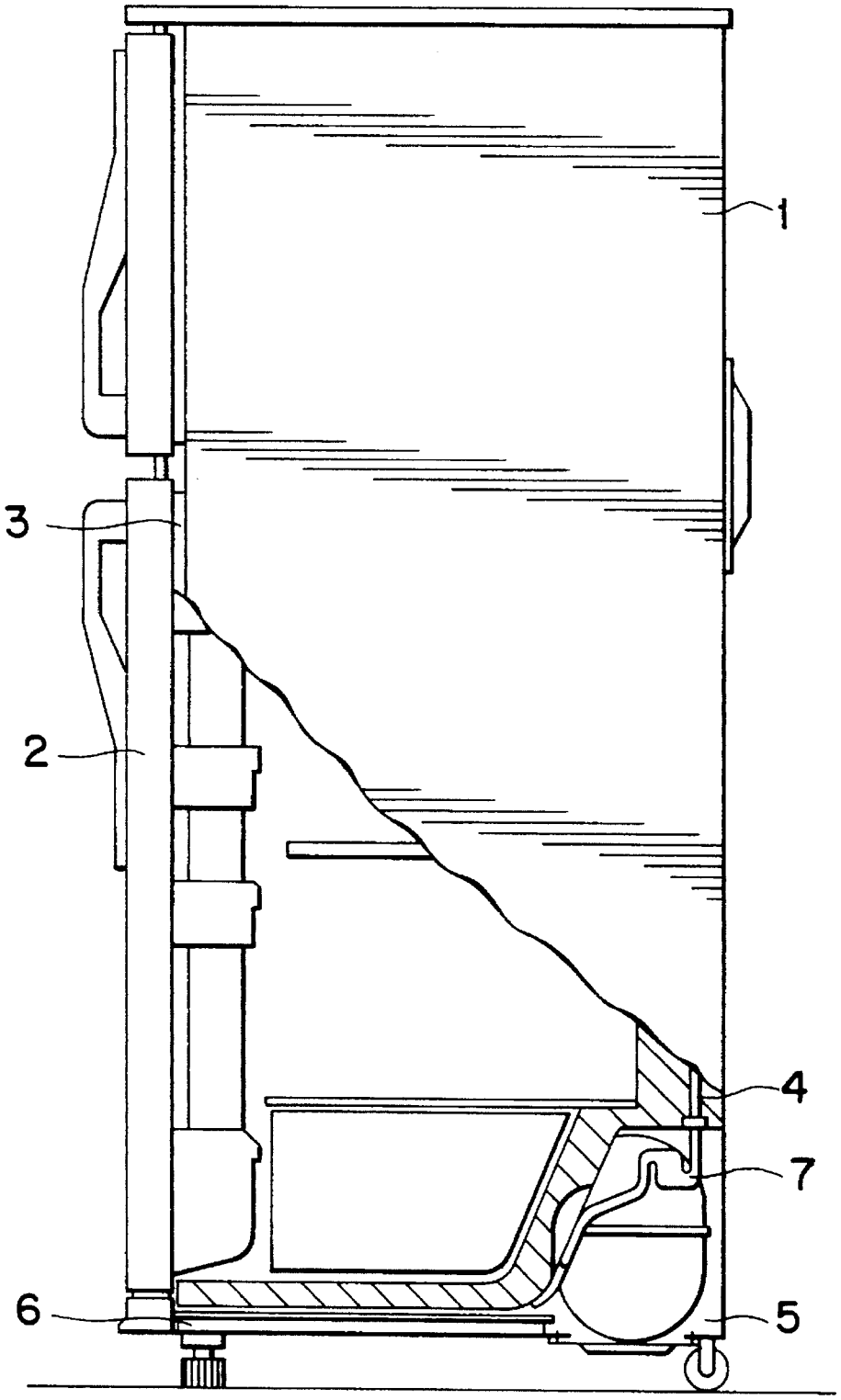
FIG. 4 (PRIOR ART)
FIG. 4 is a side view, partially cut away, of a refrigerator having a prior art reservoir tube.

Next, FIG. 3 depicts a second embodiment of the pressure equilibrium apparatus comprising a first venting pipe 10 which is connected to the interior of the compartment for discharging the defrost water generated from the evaporator (not shown), a second venting pipe 20 which is connected to the periphery of the refrigerator, and a reservoir tube 130 which is connected to both the first venting pipe 10 and the second venting pipe 20. The reservoir tube 130 provides an ambient air opening or air passage 132 which is formed above a water surface of an inside air conduit portion 134. Around the circumference of the opening 132 a flange 133 is formed for supporting a closure member 140.

The closure member 140 is formed to be able to float on the surface of the trapped water. The closure member 140 moves up and down along an inner wall of the inside air conduit portion 134 which is connected to the first venting pipe 10. The closure member 140 comprises a stem 141 which has a smaller outer diameter than the inner diameter of the inside air conduit portion 134, and a head portion 142 which is integrally formed with the stem 141 and has a larger outer diameter than the inner diameter of the opening 132 for opening/closing the opening 132. Moreover, an under-surface of the head 142 always makes contact with the upper-surface of the flange 133, not allowing the inflow of the outside air through the gap therebetween, whenever the cold air pressure of the compartment equals the ambient air pressure. Formed in the stem 141 in a longitudinal direction is a groove 143 for guiding the inflow of the outside air. When cold air pressure of the compartment is lower than ambient air pressure, the level of the trapped water contained in the inside air conduit portion 134 is elevated so that the closure member 140 is gradually moved up. Therefore, the opening 132 is opened and the outside air inflows through the groove 143 into the compartment. The level of the water contained in the inside air conduit portion 134 is thereby lowered and simultaneously the closure member 140 is moved down to close the opening 132. The operation of this second embodiment will be described later.

Operation of First Embodiment

The pressure equilibrium apparatus of the refrigerator built as described above is operated as follows. In the first embodiment, when defrost water is generated at the evaporating chamber in which the evaporator is housed, the water runs through the first venting pipe 10 to be collected in the reservoir tube 30. A predetermined volume of the water is trapped in the reservoir tube 30 and an excess water overflows the tube 30 through the second venting pipe 20 toward the outside or the evaporating dish 6, in which the water is evaporated. The water collected in the reservoir tube 30 comes to the normal pressure state, in which the water level is X and XX. The water level X of the one end 31 of the reservoir tube 30 is the same as the water level XX of the other end 32 of the reservoir tube 30. If, while in this normal state, the door is once opened and closed, the pressure of the inside of the compartment becomes lower than that outside thereof.

Accordingly, owing to the difference between the pressure of the first venting pipe 10 and that of the second venting pipe 20, the water in the one end 31 of the reservoir tube 30 flows into the other end 32 thereof through the bypass tube 40. Therefore, the water level XX of the other end 32 is elevated relative to YY, while the water level X of the one end 31 is lowered relative to Y. Thus, the one end 41 of the bypass tube 40 which was submerged in the defrost water becomes opened. The air disposed above the water surface of the one end 31, or an inflow through the second venting pipe 20, then flows into the compartment via the bypass pipe 40 and the first venting pipe 10. Finally, the pressure inside of the chamber and that of the ambient air reaches equilibruim. Since the pressure equilibrium is achieved when the ambient air flows in through the bypass pipe 40, the water level YY of the other end 32 of the reservoir tube 30 is gradually lowered to XX, and the water level Y of the one end 31 of the reservoir tube 30 is gradually elevated to X, thereby establishing the normal pressure state.

Operation of Second Embodiment

Next, in the second embodiment, when the normal state exists, the reservoir tube 130 contains trapped water or a predetermined volume, and the outside air conduit opening 132 is closed by the member 140. However, if the door is opened and closed, the pressure inside of the compartment becomes lower than that outside thereof. Therefore, the water level of the inside air conduit portion 134 is relatively elevated, and simultaneously the closure member 140 floats up with the elevating water surface. Finally, the opening 132 is opened. The outside air flows into the inside of the compartment through the groove 143 of the stem 141, thereby achieving equilibrium between the pressure inside chamber and that of the outside thereof. The water level of the inside air conduit portion 134 is gradually lowered, and the closure member 140 is also lowered to close the opening 132. Whenever defrosting water is generated, the water flows down to the reservoir tube 130 through the gap between the reservoir tube 130 and the stem 141 of the closure member 140. Since the reservoir tube contains trapped water, the outside air can not flow into the compartment and also the air of the compartment can not discharge to the outside. If the effect of the air barrier can be achieved by another shape of reservoir tube, the configuration need not necessarily be restricted to the "U" shape. Additionally, the reservoir tube 30 need not always be positioned outside of the compartment, but may be placed in a wall of the compartment.

The pressure equilibrium apparatus according to the first environment of the invention provides a bypass tube which forms an air passage bridging respective ends of the reservoir tube. Further, the second embodiment of the apparatus provides a closure member in an air passage, which closure member floats on the water. As the outside air flows to the compartment through the air passage due to the pressure difference generated after closing the door, a pressure equilibrium between the compartment and the ambient air is achieved, thereby enabling the door to be more easily opened.

What is claimed is:

1. A refrigerator comprising:

a refrigerating food storage compartment having a door;

a water conduit for conducting defrost water out of said compartment and including a water trapping portion disposed intermediate the ends thereof for preventing an air transfer between said compartment and the ambient air disposed outside of said compartment during a first pressure condition wherein a pressure in said compartment is equal to that of said ambient air; and a pressure equalizing means for equalizing pressure between said compartment and said ambient air in response to a second pressure condition, wherein a pressure within said compartment is lower than that of said ambient air, said pressure equalizing means comprising air passage means for being opened from a closed state to communicate ambient air pressure with said compartment in response to a suctioning-back of water in said conduit during said second pressure condition.

2. The refrigerator according to claim 1 wherein the water trapping portion includes an upright wall, one end of said passage means passing through said upright wall whereby said one end is opened and closed in accordance with a level of water along said upright wall.

3. The refrigerator according to claim 1 further including a valve in said passage means for opening and closing said air passage means, said valve being under the influence of a water level in said water conduit for being opened and closed in response to such water level.

4. A refrigerator comprising:

a refrigerating compartment having a door;

a water conduit for conducting defrost water out of said compartment and including a water trapping portion disposed intermediate the ends thereof for preventing an air transfer between said compartment and the ambient air disposed outside of said compartment when a pressure in said compartment is equal to that of said ambient air; and a pressure equalizing device for equalizing pressure between said compartment and said ambient air in response to the creation of a pressure within said compartment that is lower than that of said ambient air;

wherein a level of water in said water trapping portion is at a first height when pressure in said compartment is equal to that of said ambient air and moves to a second, lower height in response to pressure in said compartment becoming less than that of said ambient air, said pressure equalizing device comprising a by-pass passage having a first end connected to said water trapping portion at an intermediate height disposed between said first and second heights so that said first end is closed by trapped water in said water trapping portion when a level of said trapped water is at said first height, and opened to said ambient air when said level of said trapped water is at said second height, said by-pass passage including a second end communicating with said compartment.

5. A refrigerator comprising:

a refrigerating compartment having a door;

a water conduit for conducting defrost water out of said compartment and including a water trapping portion disposed intermediate the ends thereof for preventing an air transfer between said compartment and the ambient air disposed outside of said compartment when a pressure in said compartment is equal to that of said ambient air; and a pressure equalizing device for equalizing pressure between said compartment and said ambient air in response to the creation of a pressure within said compartment that is lower than that of said ambient air;

wherein a level of water in said water trapping portion is at a first height when pressure in said compartment is equal to that of said ambient air and moves to a second height in response to pressure in said compartment becoming less than that of said ambient air, said pressure equalizing device comprising an air passage for communicating said compartment with ambient air, and a closure member including a first portion arranged to open and close said air passage, and a second portion arranged to rise and fall with said water level and operably connected with said first portion to cause said air passage to open when said water level moves to said second height.

6. The refrigerator according to claim 5, wherein said second portion is movable within said air passage and has a smaller cross section than said air passage to allow air to flow therepast.

7. The refrigerator according to claim 6, wherein said second height is higher than said first height, said second portion being mounted at an upper end of said first portion and being arranged to seat upon an upper end of said air passage.

8. A method of facilitating the opening of a refrigerator door by equalizing pressure between the interior of a refrigerating compartment and ambient air, said method comprising the steps of:

A) draining defrost water from within said refrigerator through a water conduit which communicates with ambient air;

B) trapping water in said water conduit to prevent the flow of air between said compartment and ambient air, a level of trapped water changing in response to the creation of a pressure in said compartment which is lower than that of said ambient air;

C) providing an air passage for communicating said compartment with said ambient air, said passage being normally closed when pressure in said compartment equals the pressure of said ambient air; and D) causing said air passage to open automatically in response to said change in height of said water level when said compartment pressure is less than the pressure of said ambient air, so that said pressures of said compartment and ambient air equalize.

9. The method according to claim 8, wherein step D comprises arranging said air passage so that said trapped water blocks said air passage when the level of said trapped water is above a preset elevation.

10. The method according to claim 8, wherein step D comprises providing a movable closure device for opening and closing said air passage, and arranging a portion of said closure device to float on said trapped water for producing movement of said closure device to open and close said air passage.

* * * * *